United States Patent [19]

Hubachek

[11] 4,099,535

[45] Jul. 11, 1978

[54] LIGHT EMITTING WALKING CANE

[76] Inventor: Louis H. Hubachek, 870 S. Gramercy Pl., No. 2, Los Angeles, Calif. 90005

[21] Appl. No.: 770,572

[22] Filed: Feb. 22, 1977

[51] Int. Cl.[2] ..... A45B 3/04

[52] U.S. Cl. ..... 135/66; 135/DIG. 10; 362/102

[58] Field of Search ..... 135/66, DIG. 10; 240/6.42, 1 EL, 58; 340/321; 362/102

[56] References Cited

U.S. PATENT DOCUMENTS

| | | | |
|---|---|---|---|
| 2,271,190 | 1/1942 | Giaimo | 135/DIG. 10 |
| 2,372,471 | 3/1945 | Campbell | 135/66 |
| 2,435,650 | 2/1948 | Greene | 135/DIG. 10 |
| 2,601,554 | 6/1952 | Peters | 240/6.42 |
| 2,611,019 | 9/1952 | Warner | 240/6.42 |
| 2,642,519 | 6/1953 | Caustin et al. | 240/6.42 |
| 3,890,497 | 6/1975 | Rush | 240/6.42 X |
| 4,013,881 | 3/1977 | Sargent | 240/6.42 |

*Primary Examiner*—Werner H. Schroeder
*Assistant Examiner*—Conrad L. Berman
*Attorney, Agent, or Firm*—Paul A. Weilein

[57] ABSTRACT

A walking cane for the blind, visible during the day or night, having an elongated tubular main shaft of light conducting material with a ground engaging tip secured to one end and a tubular handle to the other end. A cover of translucent white light transmitting material envelops most of the outer surface of the shaft and outer surface of the handle, but a portion of the shaft above the ground engaging tip is exposed to provide a window for the emission of light. This window may be dyed with a red translucent material. A solid rod of light conducting material resides within the tubular shaft and has a roughened outer surface portion which diffuses light directed axially along the shaft toward the exposed portion of the shaft. A spirally wrapped layer of pliable light transmitting plastic film envelops the rest of the outer surface of the rod and diffuses the light toward the white cover. A light generator, which can be turned on and off at will, is removably positioned within the handle for directing light axially through the shaft to cause the red and white cover to glow brightly.

16 Claims, 11 Drawing Figures

4
3
-71-
-70-
-60-
-84-

LIGHT EMITTING WALKING CANE

BACKGROUND OF THE INVENTION

This invention relates to walking canes, and more particularly to a walking cane for the blind which can be electrically illuminated at will.

Heretofore, in typical prior electrically lighted canes for the blind, there was employed a main shaft of light-conducting material having an upper section covered by a layer of white material, a lower section covered by a layer of red material, and a light source positioned to introduce light into one end of the shaft to illuminate the layers of red and white material. One disadvantage associated with such prior canes is that light is mainly concentrated along the axis of the shaft, and only incidental or randomly reflected light reaches the shaft outer surface. Consequently, the layers of red and white materials are not as brightly illuminated at night as would be desired.

Canes for the blind are subject to considerable vibration and shock, due to almost continuous tapping on pavements, curbstones, and other objects during normal use. Such cane impact is especially undesirable in electrically lighted canes for the blind, since shock and vibration tend to damage and thus shorten filament life of electric lamps employed in the generation of light. Accordingly, it would be desirable in such canes for the blind to make provision for the absorption of shock to the electric lamps, thus prolonging lamp filament life.

In lighted canes for the blind, it is desirable that the sightless user be able to readily determine whether the cane is lit or not without help from others, thus enhancing his personal safety and confidence in the use of the cane. Accordingly, it is essential that the light producing apparatus within the cane be easily accessible to the user so that he can quickly ascertain, preferably by the sense of touch, if the lamp is lit, and if not, to safely and rapidly replace the lamp or batteries, or both, as required.

Examples of illuminated canes are disclosed in the following U.S. Pat. Nos.

1,824,449—Sjoberg
2,245,349—Lombardi
2,271,190—Giaimo
2,435,650—Greene
2,597,172—Parker
2,642,519—Caustin et al U.S. Pat. No. 3,890,497 to Rush discloses an illuminated safety pole for bicycles.

In the present invention it is proposed to overcome the disadvantages of the prior art by providing an improved electrically illuminated cane wherein the red and white layers of material identifying it as a cane for the blind are better illuminated by diffused light for greater visibility at night. Provision is also made for apparatus to protect the filaments of electric light lamps used in such a cane from shock to prolong lamp usefulness. Illuminated cane apparatus is also provided which embodies a structure which will enable a blind person to simply and safely maintain it.

These and other advantages will become apparent upon a reading of the detailed description of the invention.

SUMMARY OF THE INVENTION

One object of this invention is the provision of an improved cane which is identifiable as a cane for the blind in daylight and darkness.

Another object is the provision of a lighted cane for the blind which is safe, strong, durable, and can be easily maintained.

Still another object of this invention is the provision of an improved walking cane that is identifiable during daytime as a cane for the blind by red and white external surface portions which can be illuminated with diffused light from within the cane during nighttime.

A further object is the provision of a lighted day and night cane for the blind in which the source of illumination can be easily removed as a single unit from the cane for servicing, such as the replacement of discharged batteries and defective electric lamps, and which can be accomplished by the blind user himself without help from others.

Another object is the provision of an improved lighted day and night cane for the blind wherein shock damage to light producing electric lamp filaments caused by cane impact on objects is minimized.

These and other objects will be apparent from a consideration of the following description together with the accompanying drawings.

BRIEF DESCRIPTION OF THE DRAWINGS

Referring to the drawings, which are for illustrative purposes only.

DESCRIPTION OF THE PREFERRED EMBODIMENT OF THE INVENTION

Figures 1, 2A, 2B, 3, 4, 5:
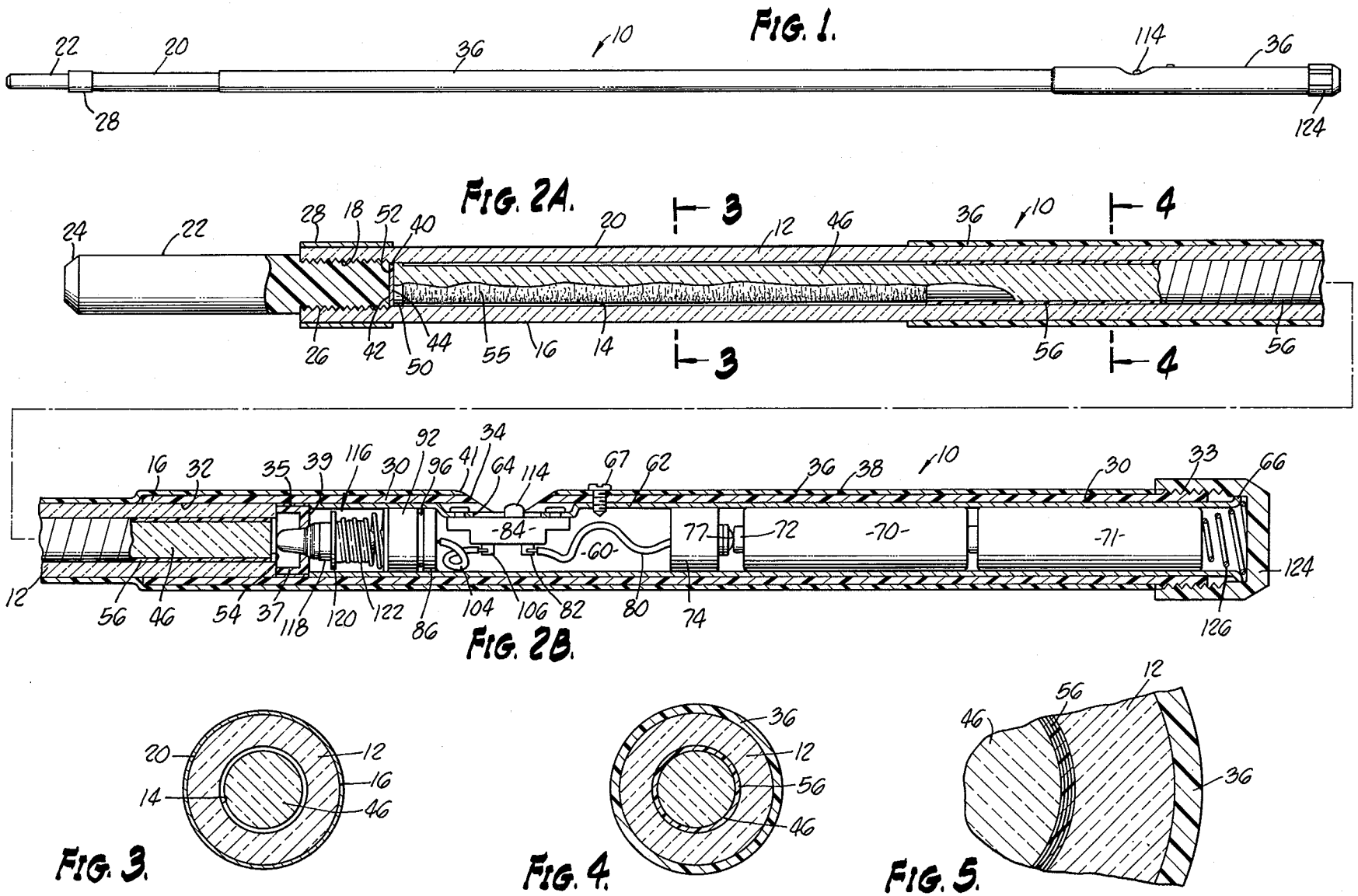
FIG. 1 is a side view of a walking cane embodying the present invention.
FIG. 2A is an enlargement of a portion of the cane of FIG. 1 illustrating a preferred embodiment of the invention with parts in cross section and parts in elevation.
FIG. 2B is an enlargement of another portion of the cane of FIG. 1 illustrating the invention with parts in cross section and parts in elevation.
FIG. 3 is an enlarged cross sectional view taken along the line 3—3 of FIG. 2A.
FIG. 4 is an enlarged cross sectional view taken along the line 4—4 of FIG. 2A.
FIG. 5 is an enlarged fragmentary portion of FIG. 4.

Referring to the drawings and in particular to FIGS. 1, 2A, 2B, and 3–7, the walking cane 10 of the present invention is illustrated as having a main shaft in the form of an elongated tubular member 12 having internal and external surfaces 14 and 16. The tubular member 12 is preferably fashioned from a light, transparent, thermoplastic material which is capable of conducting light, such as, for example, Plexiglass, or the like. The internal surface 14 of one end portion of the tubular member 12 has internal threads 18. A first cover or layer 20 of translucent red light transmitting material may be provided to envelop a portion of the outer surface 16 of the tubular member 12. The cover 20 can be applied by staining the surface 16 with red translucent dye or paint, or any such material which is capable of transmitting light without being transparent. Preferably, the cover 20 must be smear and waterproof. In daylight, it is desirable that the cover 20 be deep red in color, and at night, when illuminated, emit glowing visual red light, as will hereinafter be more fully set forth.

A wear tip or ground engaging member 22 is provided which is shown as a solid rod member having a beveled edge 24 at its ground engaging end portion. The tip member 22 is reduced in diameter at its other end portion and is provided with screw threads 26 for engagement with threads 18 of the tubular member 12. The tip member 22 should be fashioned from wear resistant material, and could be any of a group of strong, elastic and durable synthetic substances made by polymerization of aliphatic dicarboxylic acids, such as preferably, Nylon, for example, or the like. A ring 28, preferably made of steel or brass, is bonded to the outer surface 16 of the tubular member 12 to strengthen the joint formed by the threads 18 and 26 of the tubular member 12 and wear tip 22. The other end of the tubular member 12 is positioned deep enough within one end of a tubular handle 30, and outer surface 16 secured as by bonding to the inner surface 32 of handle 30 to provide a strong rigid joint. The handle 30 can be a hollow tube with its other end outer surface threaded at 33 and made of strong, light material which is resistant to breakage, such as ABS or PVC plastic, or the like, and is provided with an opening 34 through its wall. A brass ring 35 carrying a plug member 37 having a tapered opening 39 is force fitted within the handle 30 to abut the end of the tubular member 12, as shown in FIG. 2B. The plug member 37 can be fashioned from any of several thermoplastic synthetic resins produced by the polymerization of ethylene such as polyethylene, or any similar material that has comparable cushioning or soft, resilient characteristics.

A second cover 36 of translucent white light transmitting material is provided to envelop the rest of the outer surface 16 of the tubular member 12 and the outer surface 38 of the handle 30. This is accomplished by positioning a tube fashioned from the material over these members and heat shrinking it, as is well known in the art, until it fits closely about surfaces 16 and 38 of these members. An opening 41 which opposes the opening 34 of the handle 30 is provided through the cover 36. The cover 36 should be made from a material that is distinctly white in color in daylight and capable of transmitting light without being transparent, such that in darkness when illuminated with light, it glows and emits white light. The cover 36 can be any one of a group of olefins, including polyethylene and polystyrene, produced by polymerization with catalysts at low pressure, polyolefin, for example. Thus fashioned, the cover 36 is durable, easy to clean, seamless, and resists wear.

Figure 6:
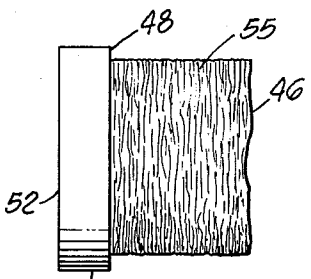
FIG. 6 is an enlarged fragmentary portion of a part of the cane illustrated in FIG. 2A.

A metallic disc 40, formed from aluminum or the like, is carried within the tubular member 12 and has one face 42 abutting the threaded end portion of the tip member 22, and another highly polished face 44 for the reflection of light. A solid rod member 46 fashioned from Plexiglass, or similar light conducting material, is also carried within the tubular member 12, and is provided with an enlarged diameter or flange portion 48 on one end, as best shown in FIG. 6. The flange portion 48 has an outer surface 50 and a polished end surface 52. The other end surface 54 of the rod 46 is also highly polished. The outer flange surface 50 has a diameter substantially equal to the diameter of the tubular member inner surface 14 such that when the rod member 46 is positioned within the tubular member 12, as best shown in FIG. 2A, with the face 44 of the disc 40 abutting the flange surface 52, the rod member 46 will be restrained from lateral movement, and any light entering the rod end surface 54 would be reflected back by the disc surface 44 to increase light intensity within the rod member 46. As shown in FIG. 2A, the rod member 46 extends substantially from disc 40 to the end of the tubular member 12 secured within the handle 30. To diffuse or scatter light traveling axially along the rod member 46 toward the red translucent material cover 20 and to achieve intense, uniform, red glow thereof, the entire outer surface 55 of the red member 46 between the flange portion 48 and just slightly within cover 36, as shown in FIG. 2A, is etched, turned, or otherwise roughened to provide a rough textured surface. The rest of the outer surface of rod member 46 is polished, and spirally wrapped with a strip 56 of pliable, plastic material such as "SARAN WRAP" or the like, to provide a cushion for the rod member such that it does not directly contact the inner surface 14 of the tubular member 12, or move laterally to rattle or rap thereon. The pliable wrapping strip 56 also serves to prevent longitudinal movement of the rod member 46, and to diffuse light from within the rod member toward the cover 36 which will emit intense, white, glowing light that is highly visible at night.

Removable light generating apparatus 60 for the cane 10 is contained within a tubular housing 62, fashioned from brass, steel or aluminum tubing, having an opening 64, and a flared end 66. The housing 62 is adapted for close fitting, sliding insertion into handle 30 to abut the ring 35 and the plug 37 at one end. The housing 62 is of such length that the flared end 66 extends slightly beyond the end of the handle 30 when fully inserted, with the opening 64 opposing the handle opening 34. A sheet metal screw 67 extends through openings in the handle 30 and the cover 36, and is threadedly engaged with a threaded hole in the housing 62, thus serving to prevent the housing 62 from rotating or moving longitudinally within the handle 30 until it is removed.

A battery positive terminal contactor 73 has a support member 74 of brass, steel, or aluminum, which is fashioned in the form of a plug with an opening 75. A brass eyelet 76 with an electrical contact member 77 on one end is mounted within the opening 75. The eyelet 76 is insulated from the member 74 by an electrical insulator insert 78. The support member 74 is secured by spot welding to the inner surface of the housing 62. This support member 74 is positioned at such a distance from the flared end 66 so as to provide sufficient space for a pair of batteries 70, 71 inserted in tandem arrangement within the housing 62, with the positive terminal 72 of the battery 70 making electrical contact with the member 77. One end of a wire 80 is positioned within the eyelet 76 and soldered therein to provide a conducting path connection with the contact member 77, while the other end is secured, also by soldering, to one terminal 82 of a switch 84. Another metallic ring member 86 having an opening 88 is secured within the housing 62 as by soldering.

Figure 7:
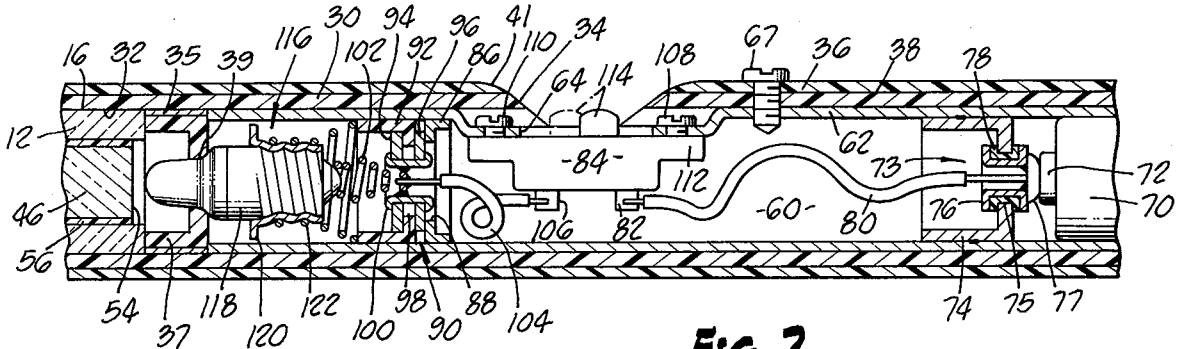
FIG. 7 is an enlarged fragmentary portion of FIG. 2B.

A lamp contact assembly, generally designated by the numeral 90, best shown in FIG. 7, consists of a plastic plug 92, a pair of metallic washers 94, 96, positioned one on each side of the opening 98 in the plug 92, a metallic eyelet 100, and a metallic spiral contact spring 102 which is tapered at both ends, assembled as shown. The eyelet 100, one end of the spring 102, and one end of a wire 104 are soldered together. The lamp contact assembly 90 is positioned within the housing 62 and the wire 104 is threaded through the opening 88 of the ring 86. The plug 92 is force fitted tightly into the housing 62 and against the ring member 86. The other end of the wire 104 is connected to the other terminal 106 of the switch 84.

The switch 84, which can be a simple slide switch, is secured to the wall of housing 62, as by screw fasteners 108, 110, threadedly engaging switch plate 112. Switch 84 is positioned such that the switch button 114 is accessible through opposed openings 34, 41 and 64 of the handle 34, cover 36, and housing 62, respectively, but its outer surface does not extend beyond the inner surface of housing 62, thus providing easy sliding insertion and removal of the housing 62 into and from the handle 30.

The lamp holding assembly 116, best shown in FIG. 7, includes a lamp 118, a lamp holder 120, and spring 122. The lamp 118 is preferably type GE222, and is screwed into the internally threaded holder 120. The holder 120 is also externally threaded, and is screwed into one end of the spring 122. The other end of the spring 122 is larger in diameter than the end threadedly engaging the holder 120, and is of such size that it can be slid into the housing 62 to abut the plug 92, but remains in frictional engagement with the internal surface of housing 62, thus supporting the lamp holding assembly 116. It will be apparent that when the light generating apparatus 60 is fully inserted into the handle 30, the front end of the lamp 118 rests within the tapered opening 39 of the plug member 37, and its threaded end within the lamp holder 120 is resiliently supported by the spring 122, thus providing for shock absorption and damage protection for the filament of the lamp 118. Thus positioned, the positive terminal of the lamp 118 bears against the end of the spring 102 making positive electrical contact therewith.

An internally threaded end cap 124 carrying a spiral spring 126 is screwed down on the threaded end 33 of the handle 30 to urge the batteries 70, 71 along the housing 62 such that the positive terminal 72 of battery 70 makes positive electrical connection with the electrical contact member 77 of the eyelet 76. The spring 126 makes contact with the flared end 66 of the housing 62, and the negative terminal end of the battery 71 to complete the electrical circuit of the light generator 60 which additionally includes wire 80, switch 84, wire 104, eyelet 100, spring 102, lamp 118, holder 120, spring 122, and housing 62.

Figure 8:
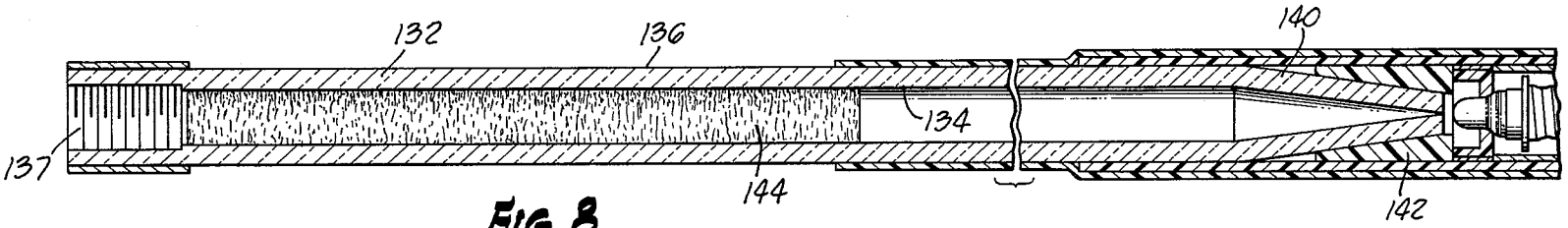
FIG. 8 is a cross sectional view illustrating a modification of the invention.
Figure 9:
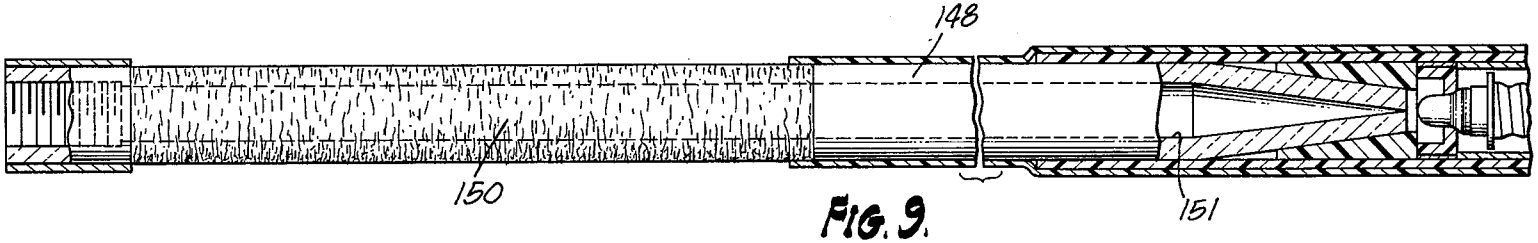
FIG. 9 is a cross sectional view illustrating another modification of the invention.
Figure 10:
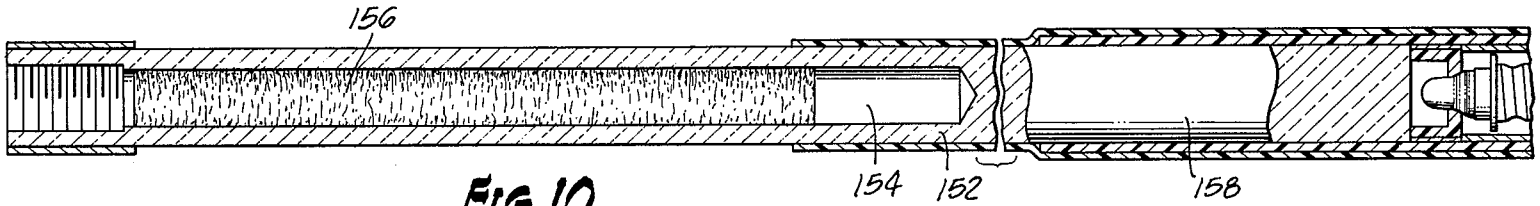
FIG. 10 is a cross sectional view illustrating still another modification of the invention.

Reference is now made to FIG. 8 wherein there is illustrated an elongated, hollow tubular member 132 having internal and external surfaces 134 and 136, respectively. The tubular member 132 is preferably fashioned from Plexiglass, or like material, which is a light thermoplastic, capable of conducting light. Internal surface 134 at one of the member 132 is provided with internal threads 137 similar to the threads 18 of the tubular member 12 illustrated in FIG. 2A. The other end of the tubular member 132 is tapered at 140 and carries a molded Plexiglass sleeve 142 having an outside surface diameter substantially equal to the diameter of the inner surface 32 of the handle 30, illustrated best in FIG. 2B. A portion of the inner surface 134 is etched, turned, or otherwise roughened to provide a rough surface 144. Thus, light traveling axially through the tube 132 from a light source 146 diffuses or scatters toward the outer surface 136 of the tube. It will be readily apparent that the cane 10, best shown in FIGS. 2A, 2B, and 7 can be readily modified by substituting the tube 132 for the tubular member 12 and rod member 46, simply by screwing the threaded tip member 22 into the threads 137 of the tube 132 and securing the end of the tube 132 carrying the sleeve 142 within handle 30. A layer of red translucent material, such as the layer 20 of FIG. 2A, can be applied to the portion of outer surface 136 enveloping the etched portion 144 of the inner surface 134. Similarly, a layer of white translucent material, such as the layer 36 of FIG. 2A, can also be applied to the rest of outer surface 136 and handle 30. FIG. 9 illustrates another tube member 148 somewhat like the tubular member 132 of FIG. 8, but which differs in that its outer surface 150 is etched or roughened while its inner surface 151 remains smooth. FIG. 10 shows still one other member 152 having a tubular portion 154 which has its internal surface partly roughened as at 156, and a solid rod portion 158. It will be apparent that tubular members 148 and 152 of FIGS. 9 and 10, respectively, can be readily incorporated with the tip member 22 and handle 30 of FIGS. 2A and 2B to provide additional modified constructions of the present invention.

The detailed description herein of the presently preferred embodiments of the invention will suggest various changes, substitutions and other departures from the disclosure within the spirit and scope of the appended claims.

I claim:

1. A walking cane comprising:

an elongate staff of generally tubular construction having a ground engaging tip portion at one end and a handle portion at the other end;

means on the outer surface of said staff providing surrounding light transmitting areas in end-to-end relation on said staff of different colors respectively adjacent said tip portion and said handle portion;

light generating means in the handle portion including a switch controlled electric lamp;

light conducting elongate cylindrical means within said staff extending along said light transmitting areas and having one end positioned to axially receive light from said lamp, and an opposite end portion adjacent said tip portion; and said opposite end portion of said cylindrical means having a roughened surface for producing diffused light in the light transmitting area adjacent said tip portion.

2. A walking cane as set forth in claim 1, wherein the light conducting means has a uniform outer diameter, is of solid cross-section at its light receiving end, and is of tubular configuration with an annular wall in said light transmitting area, and in which the roughened surface is on the inner surface of said annular wall in the light transmitting area adjacent said tip portion.

3. A walking cane as set forth in claim 1, wherein said light generating means comprises a unit assembly removably mounted in said handle portion, said assembly including:

an elongate tubular metallic housing removably supported in the staff handle portion for endwise removal therefrom;

manually operable means including a screw cap on the handle portion normally retaining said housing within the handle portion, but being operable to permit removal thereof;

means operatively supporting said electric lamp at the inner end of said housing;

a battery contained within the outer end portion of said housing;

said switch being supported in a wall of said housing; and an energizing circuit for said lamp in which said housing connects one terminal of the battery to one terminal of the lamp, and said switch is operatively positioned in a circuit conductor connection between the other terminal of said lamp and the other terminal of said battery.

4. A walking cane as set forth in claim 1, wherein the light conducting means comprises a single solid rod, and in which the roughened surface is an exterior surface of the rod in concentric relation to the light transmitting area adjacent said tip portion.

5. A walking cane as set forth in claim 4, wherein said rod has a flanged end adjacent said tip portion for restricting lateral movement of this end of said rod.

6. A walking cane as set forth in claim 5 further comprising:

a light reflector member having a reflecting surface facing said flange end.

7. A walking cane as set forth in claim 5, which further comprises:

a cover of light diffusing material enveloping the outer surface of said rod for directing light toward the area adjacent said handle portion and restricting lateral and longitudinal movement of said rod.

8. A walking cane as set forth in claim 1, wherein the light conducting means comprises an elongate tubular member having an annular wall of uniform diameter in said light transmitting areas and being tapered to a reduced diameter at its light receiving end.

9. A walking cane as set forth in claim 8, in which the roughened surface is on an outer surface of said annular wall in the light transmitting area adjacent said tip portion.

10. A walking cane as set forth in claim 8, in which the roughened surface is on an inner surface of said wall in the light transmitting area adjacent said tip portion.

11. A walking cane as set forth in claim 1, wherein said light generating means comprises:

a metal tube within said handle, said tube having a straight end positionable adjacent the other shaft end, a flared end positionable adjacent the handle other end, and a wall opening substantially opposing handle openings;

a battery terminal contactor secured within said tube intermediate the openings and the tube flared end;

a lamp contactor secured within said tube intermediate the openings and the tube straight end;

a switch electrically interconnecting said battery contactor and said lamp contactor, said switch being secured within said tube having a switch actuator accessible through the openings;

an electric lamp;

metal lamp holder means secured to the lamp negative electric terminal, said lamp holder means being positionable within said tube adjacent the other shaft end with the lamp positive electric terminal in engagement with said lamp contactor;

an electric battery positionable within said tube with a positive electric terminal in engagement with said battery contactor; and an electric current conductor carried by a cap for interconnecting the battery negative electric terminal and the metal tube flared end.

12. A walking cane as set forth in claim 11, wherein said battery terminal contactor comprises:

a metal member secured to the inner surface of said tube and having an opening, an electric insulator insert within the opening, a metal eyelet member carried by said insulator insert, said eyelet member being electrically connected to said switch and in electrical connection with the positive electric terminal of said battery.

13. A walking cane as set forth in claim 11, wherein said lamp contactor comprises:

an electric insulator plug member force fitted within said tube and having an opening, a spring member having an end secured within the insulator plug opening and connected to said switch, said spring member having the other end in engagement with the lamp positive electric terminal.

14. A walking cane as set forth in claim 11, wherein said lamp holder means comprises:

a metal holder having internal threads for accommodating the threaded electric terminal of said lamp and external threads, a spiral spring having a tapered end in threaded engagement with the metal holder external threads and the other end in frictional engagement with the inner surface of said tube.

15. A walking cane as set forth in claim 11, wherein said electric current conductor comprises:

a spiral spring having a tapered end for engagement with the battery negative terminal and the other end frictionally secured within said cap for engagement with the flared end of said tube.

16. A walking cane comprising:

an elongated main shaft of light conducting material;

a ground engaging tip secured to one end of said shaft;

a tubular handle secured at one end to the other shaft end, said handle having a wall opening;

a first cover of translucent red light transmitting material enveloping a portion of the shaft one end outer surface;

a second cover of translucent white light transmitting material enveloping the rest of the shaft and handle outer surfaces, said second cover having an opening opposing the handle wall opening;

light generating means removably positioned within said handle for directing light axially through said shaft, said light generating means being accessible through the handle and second cover openings for on-off activation at will, said light generating means comprising:

a metal tube within said handle, said tube having a straight end positionable adjacent the other shaft end, a flared end positionable adjacent the handle other end, and a wall opening substantially opposing the handle and second cover openings;

a battery terminal contactor secured within said tube intermediate the openings and the tube flared end;

a lamp contactor secured within said tube intermediate the openings and the tube straight end;

a switch electrically interconnecting said battery contactor and said lamp contactor, said switch being secured within said tube having a switch actuator accessible through the openings;

an electric lamp;

metal lamp holder means secured to the lamp negative electric terminal, said lamp holder means being positionable within said tube adjacent the other shaft end with the lamp positive electric terminal in engagement with said lamp contactor;

an electric battery positionable within said tube with a positive electric terminal in engagement with said battery contactor;

an electric current conductor carried by a cap for interconnecting the battery negative electric terminal and the metal tube flared end;

means secured within said handle for resiliently supporting the filament end of said lamp, comprising:

a metal ring frictionally force fitted within said handle, a support member secured within said ring and having a tapered opening accommodating the filament end of said lamp, said support member being of soft resilient material; and means carried by said shaft for diffusing light toward said first cover.

* * * * *

UNITED STATES PATENT AND TRADEMARK OFFICE

CERTIFICATE OF CORRECTION

PATENT NO. : 4,099,535

DATED : July 11, 1978

INVENTOR(S) : LOUIS H. HUBACHEK

It is certified that error appears in the above-identified patent and that said Letters Patent are hereby corrected as shown below:

Column 5, line 61, after "one" insert --end--.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*